US008020684B2

(12) United States Patent
Misao

(10) Patent No.: US 8,020,684 B2
(45) Date of Patent: Sep. 20, 2011

(54) SHIFT APPARATUS FOR INBOARD-OUTBOARD DRIVE

(75) Inventor: Hideo Misao, Amagasaki (JP)

(73) Assignee: Yanmar Co., Ltd., Osaka (JP)

( * ) Notice: Subject to any disclaimer, the term of this patent is extended or adjusted under 35 U.S.C. 154(b) by 448 days.

(21) Appl. No.: 11/806,990

(22) Filed: Jun. 5, 2007

(65) Prior Publication Data

US 2007/0289838 A1 Dec. 20, 2007

(30) Foreign Application Priority Data

Jun. 15, 2006 (JP) ..... 2006-166429

(51) Int. Cl.
*F16D 25/10* (2006.01)
*F16D 25/12* (2006.01)

(52) U.S. Cl. ..... 192/85.01; 192/3.58; 192/48.601; 192/51

(58) Field of Classification Search ..... 192/87.17, 192/87.15, 85.01
See application file for complete search history.

(56) References Cited

U.S. PATENT DOCUMENTS

| | | | | |
|---|---|---|---|---|
| 3,919,510 | A | 11/1975 | Barnes | |
| 4,070,926 | A | 1/1978 | Schneider et al. | |
| 4,186,829 | A | 2/1980 | Schneider et al. | |
| 4,299,374 | A * | 11/1981 | Yamanaka | 251/129.21 |
| 4,659,315 | A * | 4/1987 | Bland et al. | 440/61 R |
| 4,836,809 | A | 6/1989 | Pelligrino | |
| 4,871,048 | A | 10/1989 | Chatterjea | |
| 5,033,983 | A | 7/1991 | Bland et al. | |
| 5,201,238 | A | 4/1993 | Hayasaka | |
| 5,238,433 | A | 8/1993 | Hayasaka | |
| 5,327,793 | A | 7/1994 | Hayasaka | |
| 5,476,400 | A | 12/1995 | Theophanides | |
| 5,492,493 | A | 2/1996 | Ohkita | |
| 5,711,742 | A * | 1/1998 | Leinonen et al. | 477/121 |
| 5,879,210 | A | 3/1999 | Goto et al. | |
| 6,129,599 | A | 10/2000 | Hallenstvedt et al. | |
| 6,554,663 | B2 * | 4/2003 | Neisen | 440/75 |

(Continued)

FOREIGN PATENT DOCUMENTS

GB 1 474 045 5/1977

(Continued)

OTHER PUBLICATIONS

Japanese Office Action issued from the Japanese Patent Office mailed on May 17, 2011 in the corresponding Japanese patent application No. 2006-166429.

(Continued)

*Primary Examiner* — David D Le
*Assistant Examiner* — Ryan Dodd
(74) *Attorney, Agent, or Firm* — Posz Law Group, PLC

(57) ABSTRACT

A shift apparatus of an inboard-outboard drive in which shift operation can be carried out by electrical means without using known cables such as wires is provided.
Solenoid valves 35 and 36 which carry out shifting operation in an oil-hydraulic circuit for operating an hydraulic clutch is attached to an oil-hydraulic control unit 31 in an upper casing 14 of an outer drive apparatus 4, and a waterproof cover 40 which covers the oil-hydraulic control unit 31 and the solenoid valves 35 and 36 are fixed on the upper casing 14. A connector 45 is interposed between electric wires 41, and arranged on a joint portion between a bell housing 18 and an upper casing 14.

9 Claims, 7 Drawing Sheets

U.S. PATENT DOCUMENTS

| | | | | |
|---|---|---|---|---|
| 6,561,336 | B1 * | 5/2003 | Huart et al. | 192/70.252 |
| 2002/0072279 | A1 * | 6/2002 | Neisen | 440/75 |

FOREIGN PATENT DOCUMENTS

| | | |
|---|---|---|
| GB | 2 079 705 | 1/1982 |
| JP | 3-10990 | 1/1991 |
| JP | 4-254289 | 9/1992 |
| JP | A-05-85476 | 6/1993 |
| JP | U-05-86088 | 11/1993 |

OTHER PUBLICATIONS

Extended European Search Report dated Jul. 7, 2011 for the corresponding European patent application No. 07290720.7-1254.

* cited by examiner

SHIFT APPARATUS FOR INBOARD-OUTBOARD DRIVE

BACKGROUND OF THE INVENTION (1) Field of the Invention

The present invention relates to a shift apparatus which shifts a clutch into forward, neutral and reverse and is provided in an outer drive apparatus of an inboard-outboard drive.

(2) Description of the Related Art

An inboard-outboard drive (a.k.a., stern drive) is a form of marine propulsion in which a main engine ((a.k.a., inboard motor) is provided inside the hull and an outer drive apparatus is provided on the outside of the hull. The outer drive apparatus is a propulsion unit which integrally incorporates a reverse reduction gear, clutch mechanism, steering mechanism, propellers and is attached to a transom portion.

In known inboard-outboard drives, a shift mechanism for switching the clutch mechanism into forward, neutral or reverse generally employs a mechanical mechanism in which a shift operation lever in the vessel and a clutch lever in the outer drive apparatus are connected by a cable such as a wire (for example, Japanese Unexamined Patent Publication No. 4-254289).

The case where an hydraulic clutch is employed in an inboard-outboard drive of this type will be described with reference to FIG. 7 as an example of the oil-hydraulic circuit: a pressure oil discharged from a gear pump 30 which receives a drive force from an output shaft of a main engine is transferred to a clutch 8 through a forward/reverse directional control valve 50. The forward/reverse directional control valve 50 is a mechanically operated valve and switched by a shifter 51. This shifter 51 is operated by a clutch lever (not shown), and the clutch lever is connected with a shift operation lever (not shown) in the vessel by a wire cable. The oil-hydraulic circuit is provided with a relief valve 56 having a slowly engaging function to reduce the impact of rapid engagement on the clutch 8. The relief valve 56 is provided with two spring bearings 56*a*, 56*b* which are in the form of hydraulic pistons capable of compressing a pressure regulating spring 56*s* and disposed serially in a cylinder 56*c*. The relief valve 56 is additionally provided with a pressure-regulating circuit formed by connecting throttling passages split from a forward output port and reverse output port of the forward/reverse directional control valve 50 to oil chambers 56*d*, 56*e* of the spring bearings 56*a*, 56*b*, respectively. When the forward/reverse directional control valve 50 is in the neutral position (as in FIG. 7), the spring bearings 56*a*, 56*b* are in the most retracted positions due to a biasing force of the pressure-regulating spring 56*s* and the relief valve 56 operates as a relief valve having a low setting pressure. When the forward/reverse directional control valve 50 is switched to forward or reverse, the spring bearing 56*a* or 56*b* moves to compress the pressure-regulating spring 56*s* with a time delay. When the setting pressure of the relief valve 56 gradually increases and the spring bearing 56*a* or 56*b* reaches a specified stroke, the maximum pressure of hydraulic operating fluid for the clutch is obtained. Thus, the pressure of the hydraulic operating fluid for the clutch is gradually increased. The drive force of the main engine is transmitted in this order: the clutch 8, the forward side gear 5 or reverse side gear 6 which is engaged with the clutch 8, a bevel gear 24, a drive shaft 23, a bevel gear 7, a propeller shaft 25, and a propeller 12.

As the clutch mechanism of the outer drive apparatus, friction clutches such as a multiple disc clutch (for example, Japanese Unexamined Patent Publication No. 4-254289) or a cone clutch (for example, Japanese Unexamined Patent Publication No. 3-10990) or claw clutches such as a dog clutch are employed.

Although more and more control systems for inboard-outboard drives are electronically controlled in recent years, mechanical mechanisms using a wire cable are still employed for shift mechanisms. When shift switching signals need to be electrical signals, the wire cable is operated by an actuator such as an electric motor installed in the vessel and controlled by electrical signals from a controller in the vessel.

However, in installing the actuator, there have been problems with the numerous man hours required to couple the main engine inside the vessel and the outer drive apparatus outside the vessel, such as for example, positioning of the wire cable for the forward, neutral and reverse positions.

Furthermore, since the wire cable have minimum bend radius and the wire cables themselves slide during switch operation, passage for the wire cable inside the outer drive apparatus is limited. Requirements for the passage in the outer drive apparatus, which has no extra space, have thus been considerably difficult to fulfill.

BRIEF SUMMARY OF THE INVENTION

Accordingly, an object of the present invention is to provide a shift apparatus of an inboard-outboard drive in which shift operation can be carried out by electrical means without using conventional cables such as wires.

To solve the above problems, in the shift apparatus of the inboard-outboard drive according to the present invention, an solenoid valve which carries out shifting operation in an oil-hydraulic circuit which operates an hydraulic clutch is disposed within a casing of an outer drive apparatus. A connector is interposed into electric wires which electrically connect the solenoid valve and an inboard controller in a vessel. The connector is arranged on a joint portion between a bell housing and an upper casing.

In one embodiment, an oil-hydraulic control unit which controls hydraulic operating fluid for the clutch is disposed within the outer drive apparatus, and the solenoid valve is attached to the oil-hydraulic control unit.

Moreover, in the shift apparatus of the inboard-outboard drive according to the present invention, an electric actuator which shifts the clutch is disposed within the casing of the outer drive apparatus. The connector is interposed into electric wires which electrically connect the electric actuator and the inboard controller, and the connector is arranged on the joint portion between a bell housing and an upper casing.

In one embodiment, a waterproof cover which hermetically seals the solenoid valve is further attached.

According to the present invention, switching of the clutch is carried out by the solenoid valve or electric actuator. Therefore, mechanical shift wires for switching the clutch as in known shift apparatuses are unnecessary. The shift apparatus of the present invention can be thus installed without positioning of the cable which has been conventionally carried out. Moreover, choosing passages for the cables inside the outer drive apparatus is facilitated.

DETAILED DESCRIPTION OF THE INVENTION

Regarding the shift apparatus of the inboard-outboard drive according to the present invention, its suitable embodiments will be described with reference to FIGS. 1 to 6.

Figure 1:
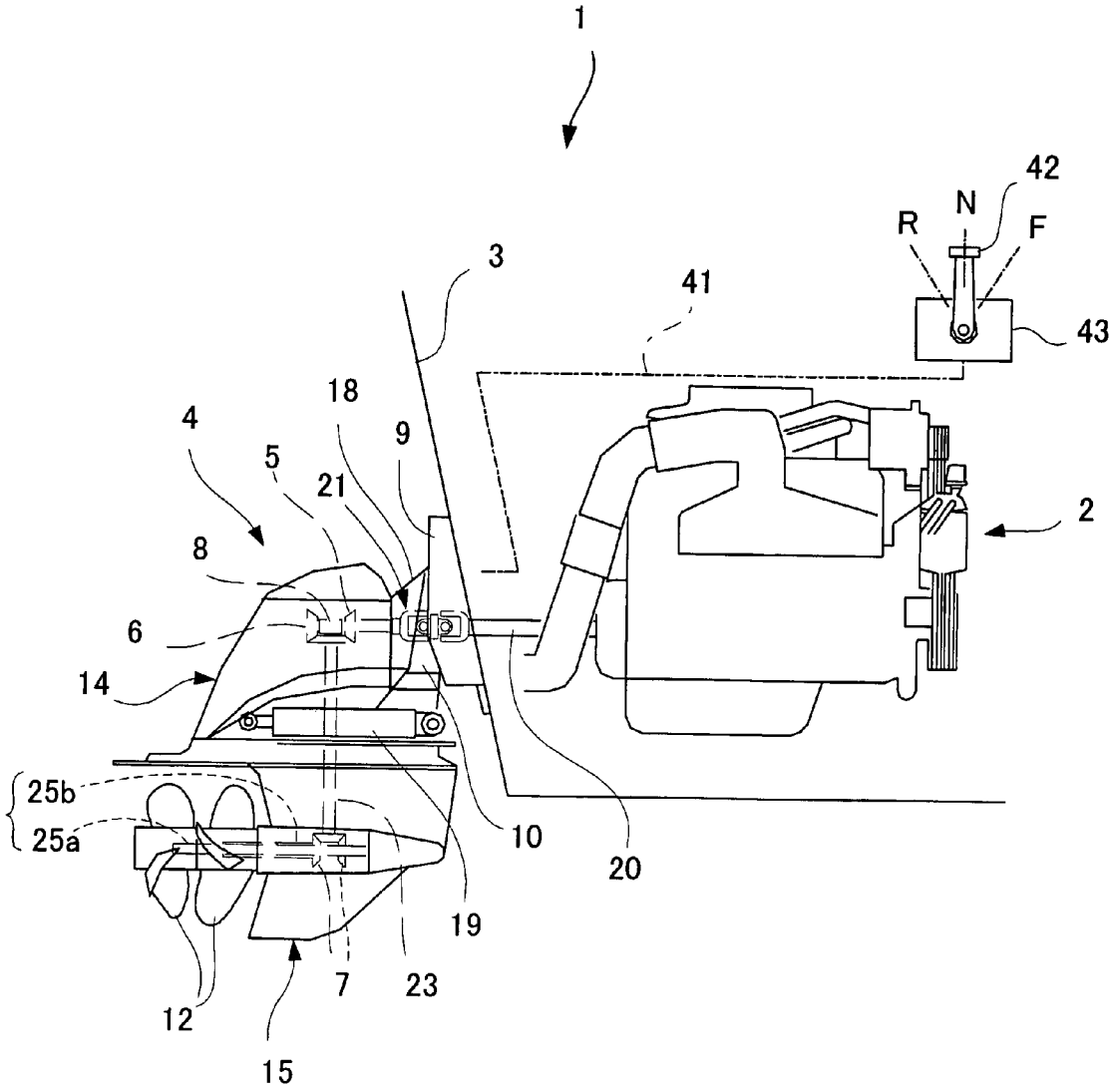
FIG. 1 is a partial sectional view of the shift apparatus of the inboard-outboard drive according to the present invention.

As shown in FIG. 1, the inboard-outboard drive 1 is provided with a main engine 2 inside a hull 3 and an outer drive apparatus 4 outside the hull 3. The outer drive apparatus 4 integrally incorporates a reverse reduction gear comprising a forward gear 5, reverse gear 6, bevel gear 7 and others, a clutch 8, a steering mechanism (9, 10, 11) (refer to FIG. 3) and a pair of front and rear propellers 12 and other components. The outer drive apparatus 4 is attached to a transom portion 13.

The outer drive apparatus 4 is provided with a casing comprising an upper casing 14 and a lower casing 15. In the example illustrated, the upper casing 14 further has an upper casing body 14*a* accommodating the forward gear 5, gear 6, clutch 8 and other components, and a cosmetic cover 14*b* which is attached to the upper casing body 14*a*. The outer drive apparatus 4 comprises a gimbal housing 9 fixed on the transom portion 13, a gimbal ring 10 supported by pivot shafts 16, 17 above and below the gimbal housing 9, and a bell housing 18 supported on the left and right side of the gimbal ring 10 via a pivot shaft (not shown). The upper casing 14 is fixed on the bell housing 18, and is thus supported freely movably vertically and horizontally. Vertical tilting of the outer drive apparatus 4 is carried out by an hydraulic cylinder 19 (FIG. 1), while horizontal tilting, i.e., steering, is carried out by a steering lever 11 (FIG. 3).

Figure 3:
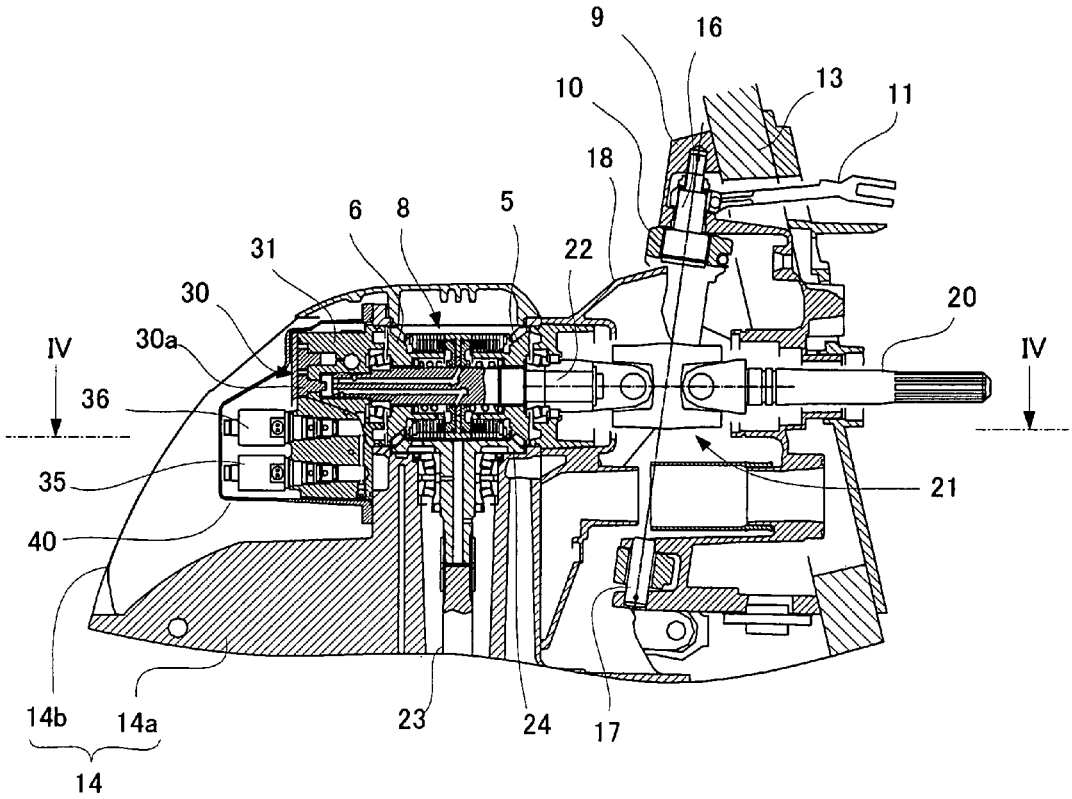
FIG. 3 is a longitudinal sectional view showing relevant parts of the outer drive apparatus of the inboard-outboard drive in FIG. 1, and is a sectional view taken along the line III-III in FIG. 4.

As shown in FIG. 3, an output shaft 20 powered by the main engine 2 is connected to a clutch shaft 22 disposed within the upper casing body 14*a* of the outer drive apparatus 4 via the universal joint 21. The clutch shaft 22 is provided with the forward gear 5 and reverse gear 6 which are rotatably fitted thereon, and a hydraulic multiple-disc clutch 8 which connects either of the forward gear 5 or reverse gear 6 to the clutch shaft 22.

The forward gear 5 and reverse gear 6 engage the bevel gear 24 fixed on the upper end of the drive shaft 23 extending in the vertical direction. The lower end of the drive shaft 23 is connected to a propeller shaft 25 consisting of a contra-rotating shaft comprising a solid shaft 25*a* and hollow shaft 25*b* via a plurality of bevel gears 7. The solid shaft 25*a* and hollow shaft 25*b* are always driven in directions opposite to each other to rotate two front and rear propellers 12.

An hydraulic pump 30 (FIG. 3) is disposed on the aft side edge of the clutch shaft 22. The hydraulic pump 30 in the example illustrated is a gear pump comprising a pair of gears. One of the gears constituting the gear pump, a gear 30*a*, is engaged with the edge of the clutch shaft 22 and rotates with the clutch shaft 22, whereby the oil is pumped up from a oil sump formed in the casing so that hydraulic operating fluid is supplied to the clutch 8. A trochoidal pump can be also used as a hydraulic pump.

An oil-hydraulic control unit 31, integrating the hydraulic pump 30 and a hydraulic control circuit which controls hydraulic operating fluid for the clutch, is attached to the aft side of the upper casing body 14*a*.

Figure 5:
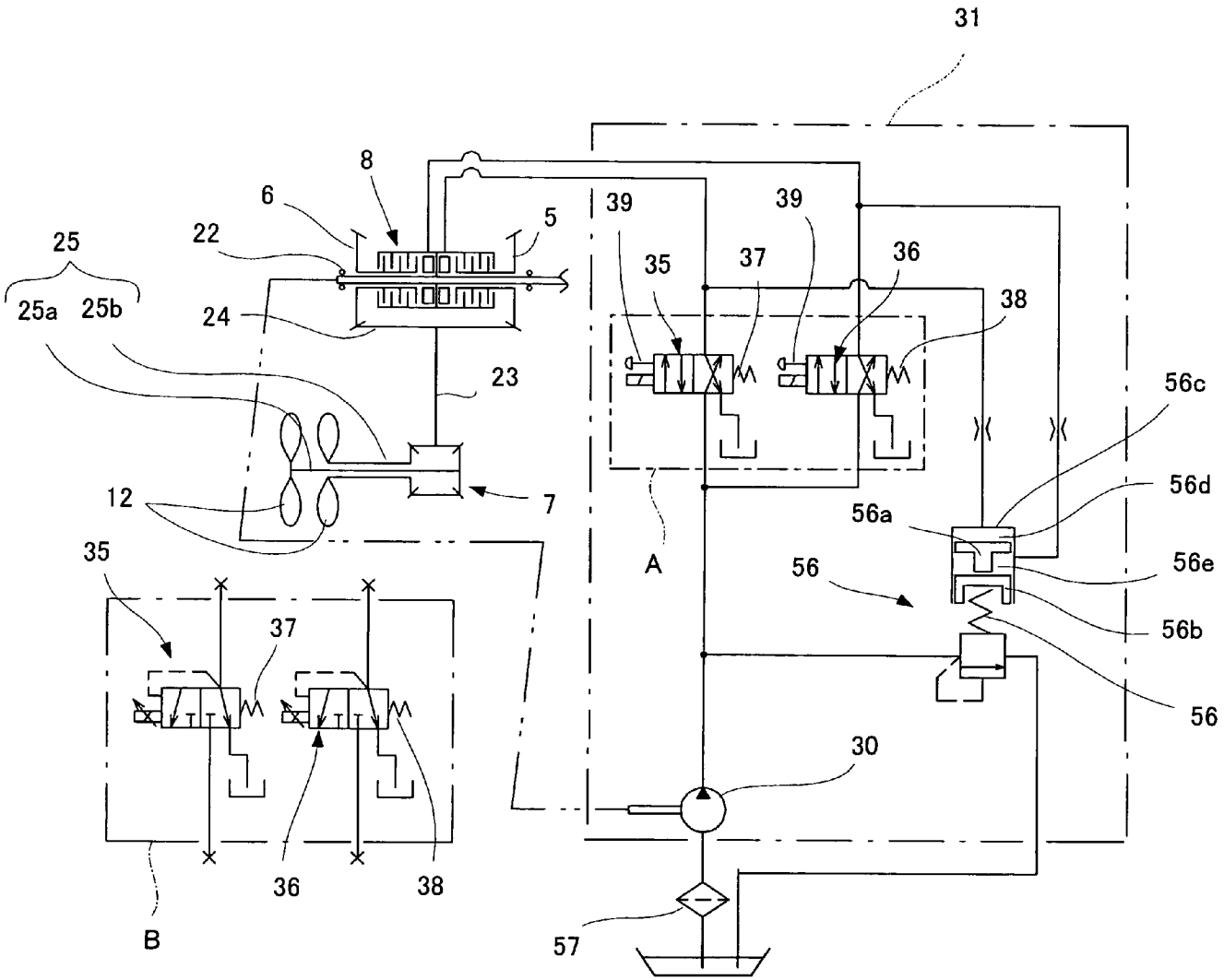
FIG. 5 is a diagram of the oil-hydraulic circuit of the outer drive apparatus in FIG. 1.
Figure 7:
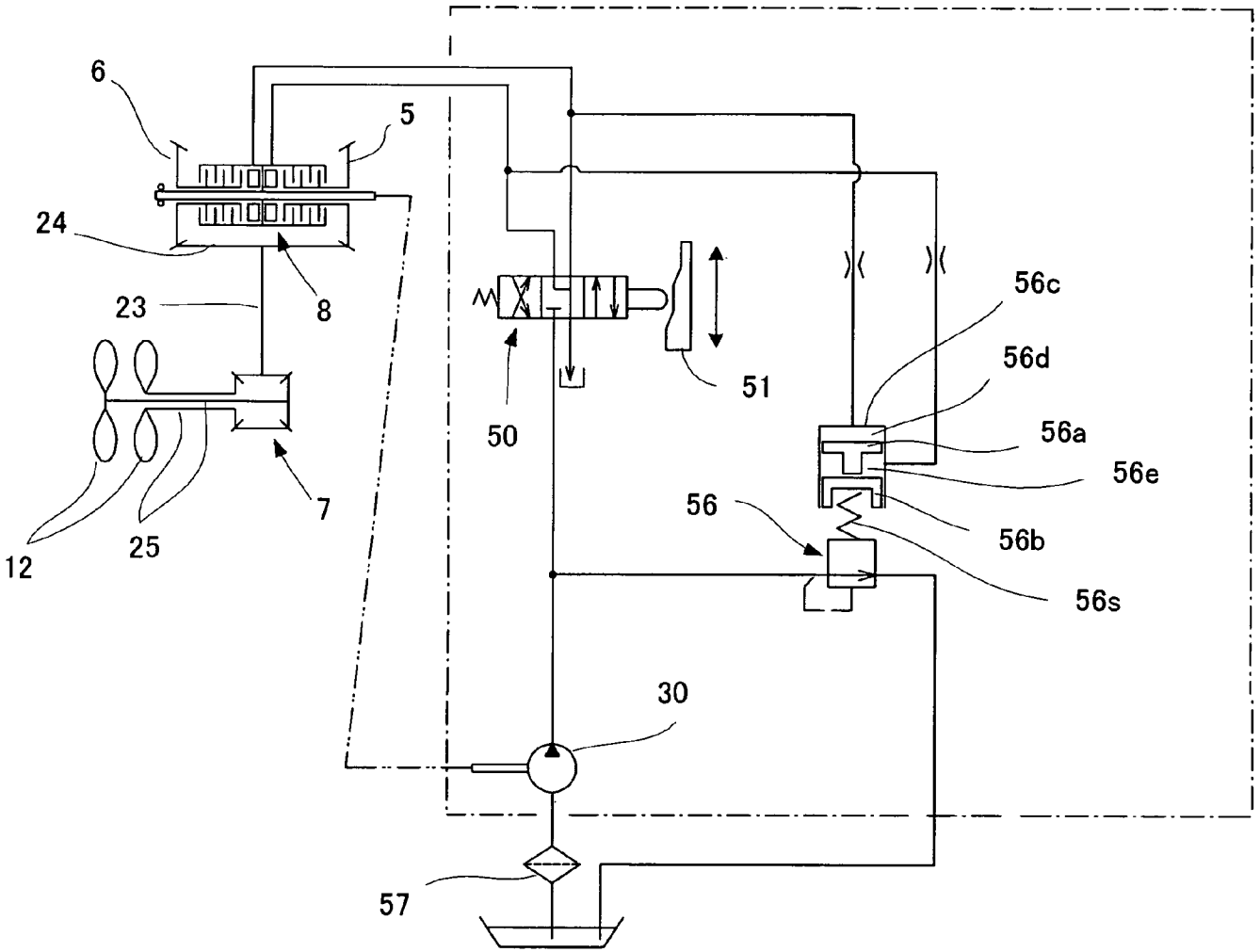
FIG. 7 is a diagram of an oil-hydraulic circuit of a known outer drive apparatus.

FIG. 5 shows a block diagram of the oil-hydraulic circuit. The basic constitution of the oil-hydraulic circuit is similar to that of the known oil-hydraulic circuit shown in FIG. 7, except that the forward/reverse directional control valve comprises solenoid valves 35, 36. The same components as in FIG. 7 will be referred to by the same numerals and their repeated explanation will be omitted.

The oil-hydraulic control unit 31 has a relief valve 56 built therein which contains the spring bearings 56*a*, 56*b*, in addition to the solenoid valves 35, 36, and an oil passage is bored therein. The forward/reverse directional control valve can also comprise proportional solenoid valves 35, 36 (chain-line square B) instead of on/off type solenoid valves (chain-line square A), which enables trolling sailing.

The solenoid valves 35, 36 are so constituted that when they are not energized, they shift to the side so as to discontinue oil supply to the clutch 8 by return springs 37, 38. If there the solenoid valves 35, 36 cannot be energized because of electric trouble such as broken electric wires, the hydraulic operating fluid supply to the clutch 8 is discharged into a drain by the return springs 37, 38, and therefore the clutch 8 is disengaged and the vessel stops. Each of the solenoid valves 35, 36 is provided with an emergency pin 39 which can be used to push the valve plate so as to manually supply the clutch with hydraulic operating fluid. Accordingly, the solenoid valves 35, 36 can be shifted manually to the side, so as to supply the clutch 8 with hydraulic operating fluid, against the force of the return springs 37, 38.

Figure 2:
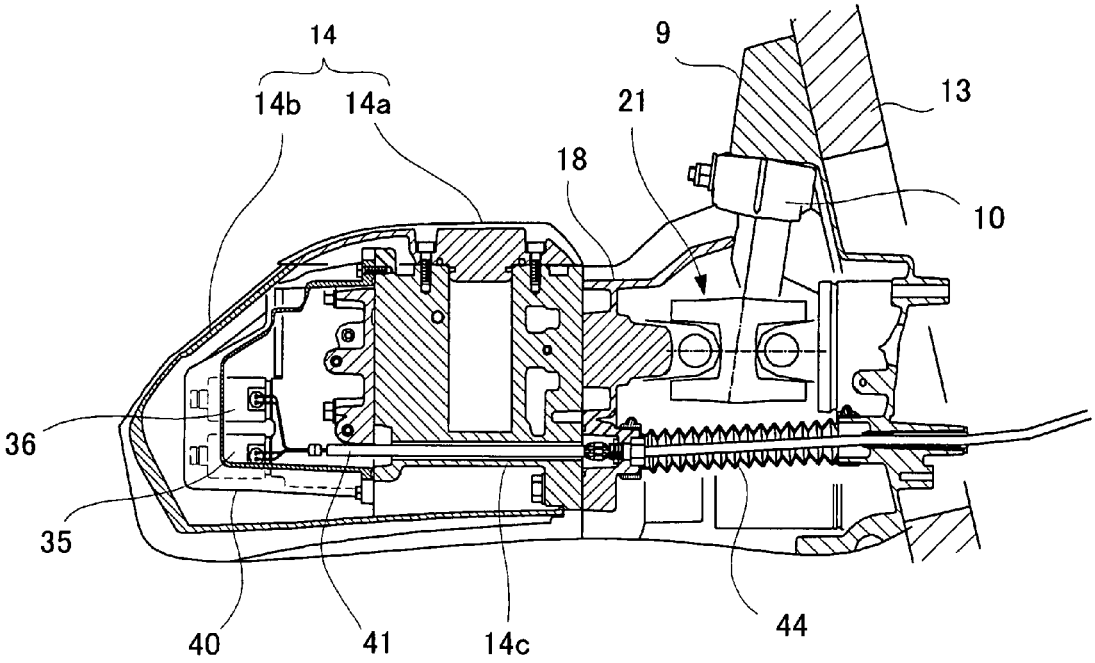
FIG. 2 is a longitudinal sectional view showing a relevant part of the outer drive apparatus of the inboard-outboard drive in FIG. 1, and is a sectional view taken along the line II-II in FIG. 4.
Figure 4:
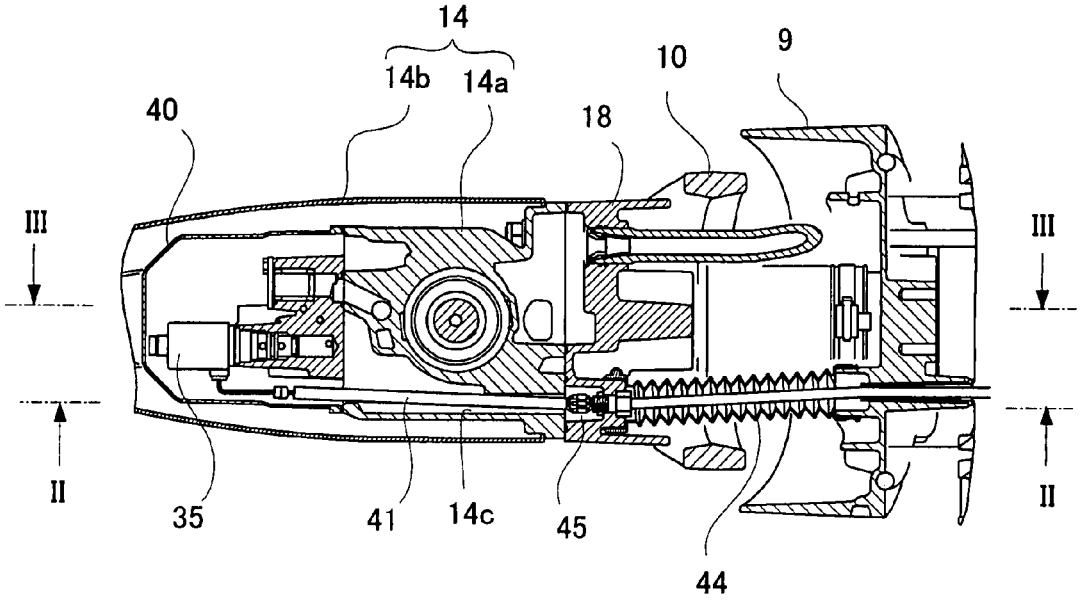
FIG. 4 is a horizontal sectional view showing relevant parts of the outer drive apparatus of the inboard-outboard drive in FIG. 1, and is a sectional view taken along the line IV-IV in FIG. 3.

The oil-hydraulic control unit 31 is positioned within a dead space of the cosmetic cover 14*b*, and is sealed against fluid by a waterproof cover 40, together with the solenoid valves 35, 36. The waterproof cover 40 is attached to the upper casing body 14*a* via a sealing packing (not shown) with bolts or the like. As shown in FIGS. 2 and 4, an electric wire 41 of the solenoid valves 35, 36 is brought into the vessel through a passage for conventional shift wire cables, and is connected to a control panel (controller) 43 on which a shift operation lever 42 (FIG. 1) is disposed. That is, the electric wire 41 is brought into the vessel through a through hole 14*c* formed on the upper casing body 14*a*, and inside a flexible hose 44 which is seal-connected between the bell housing 18 and gimbal housing 9. This causes the inner space of the waterproof cover 40 and through hole 14*c* to be open to the inside of the vessel in a fluid-tight manner, thereby preventing the occurrence of harmful condensation.

As shown in FIG. 4, the electric wire 41 is provided with a connector 45 which separably connects a male side terminal and female side terminal. The a male side terminal and female side terminal are disposed in a recess provided on each of the two joint surfaces of the bell housing 18 with the upper casing 14 and a male side terminal and female side terminal disposed on the bell housing 18 side and the upper casing 14 side, respectively. The connector 45 can be connected and accommodated inside the bell housing 18 and upper casing 14 prior to joining these components.

Figure 6:
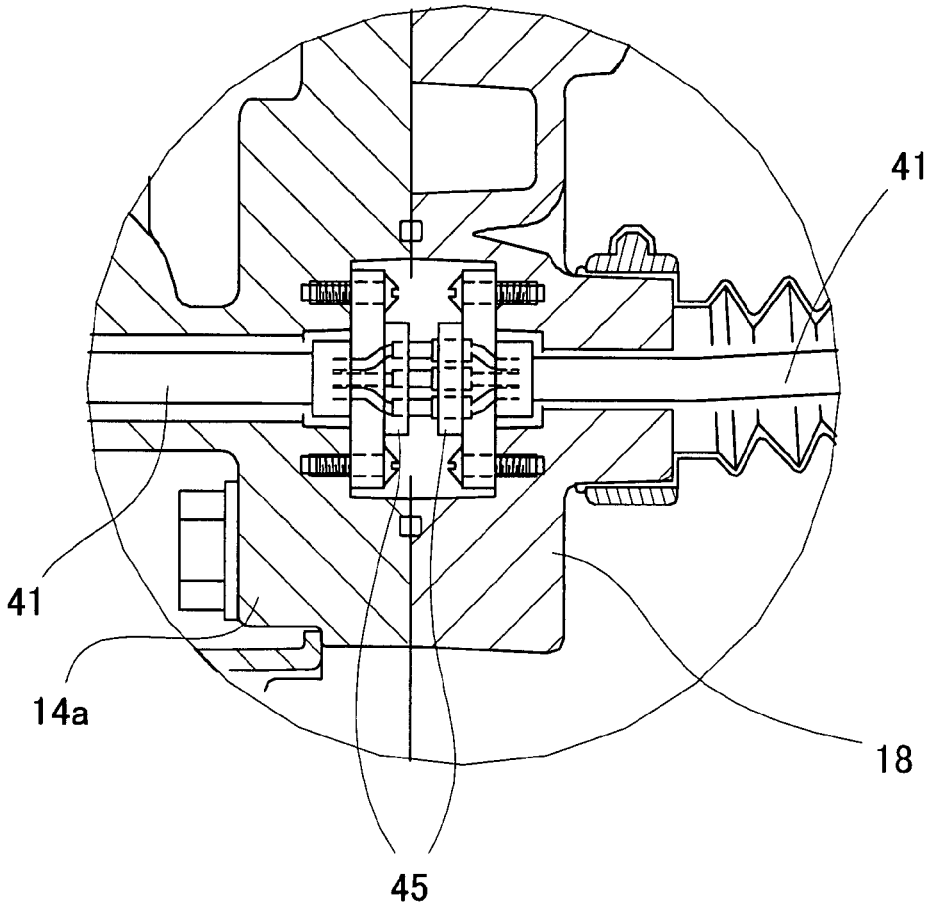
FIG. 6 is an expanded longitudinal sectional view of a connector of an electric wire.

As shown in FIG. 6, the male side terminal and female side terminal of the connector 45 can be fixed in the recesses on the joint surface of the bell housing 18 and upper casing 14. In the example illustrated, the male side of the connector 45 is fixed on the upper casing body 14*a*, and the female side of the connector 45 is fixed on the bell housing 18. By placing the connector 45 in this position, positioning the upper casing 14 and the bell housing 18 during assembly and attaching of the former to the latter, the connector 45 is connected, thereby facilitating the installment operation.

As can be seen from the above description, according to the shift apparatus of the inboard-outboard drive having the above constitution, the solenoid valves 35, 36 for conducting shifting operation in the oil-hydraulic circuit which operates the hydraulic clutch 8 are disposed in the upper casing 14 of the outer drive apparatus 4, whereby adjustment of shift positions of the electric wire 41 connected to the solenoid valves 35, 36 as in known shift wire cables is unnecessary. Moreover, the electric wires brought from the solenoid valves 35, 36 into the vessel itself does not slide by shift operation, and thus a greater allowable bending radius is ensured, which allows more freedom than in known shift wire cables. This allows more freedom in the design.

In the above embodiment, a form comprising an hydraulic multiple-disc clutch is described, but the present invention can be also applied to forms comprising other clutches. For example, it is also possible to operate a shifter 51 which operates the conventional clutch 8 shown in FIG. 7 by an electric-powered linear actuator, electric motor or other electric actuator and dispose the electric actuator in the upper housing. Moreover, it can be also applied not only to a form comprising a friction clutch but also to that comprising a claw clutch such as a cone clutch.

What is claimed is:

1. A shift apparatus for an inboard-outboard drive having an outer drive apparatus, comprising:

a hydraulic clutch disposed within a casing of the outer drive apparatus;

an oil-hydraulic circuit which operates the hydraulic clutch;

at least one solenoid valve that performs a switching operation of the oil-hydraulic circuit;

electric wires which electrically connect the solenoid valve and an inboard controller; and a connector located between electric wires, wherein a recess is formed on a joint portion between a bell housing and an upper casing, the recess including neighboring recesses respectively formed in the upper casing and the bell housing;

the electric wires include a first section, which passes through the bell housing and is located between the connector and the inboard controller, and a second section, which is located in the upper casing between the connector and the solenoid valve;

the connector is an electric coupling, which electrically connects the first section to the second section when coupled and which electrically disconnects the first section and the second section when uncoupled;

the connector is disposed in the recess when connected, and when connected the conductor spans the width of the neighboring recesses formed in the bell housing and the upper casing; and when the connector electrically connects the first section of wires to the second section of wires, the inboard controller is electrically connected to the solenoid valve.

2. A shift apparatus according to claim 1, further comprising an oil-hydraulic control unit that controls hydraulic operating fluid for the clutch located in the outer drive apparatus, wherein the solenoid valve is attached to the oil-hydraulic control unit.

3. A shift apparatus according to claim 1, further comprising a waterproof cover which hermetically seals the solenoid valve.

4. A shift apparatus according to claim 1, wherein the coupling includes a first member, which is electrically connected to the first section of the wires, and a second member, which is electrically connected to the second section of wires;

when the first member is coupled to the second member, the connector electrically connects the first section of wires to the second section of wires.

5. A shift apparatus according to claim 1, wherein the connector has a male component and a female component, which are mated when the connector is connected.

6. A shift apparatus for an inboard-outboard drive having an outer drive apparatus comprising:

a clutch disposed in a casing of the outer drive apparatus;

at least one electric actuator which shifts the clutch;

electric wires which electrically connect the electric actuator and an inboard controller; and a connector located between the electric wires, wherein a recess is formed on a joint portion between a bell housing and an upper casing, the recess including neighboring recesses respectively formed in the upper casing and the bell housing;

the electric wires include a first section, which passes through the bell housing and is located between the connector and the inboard controller, and a second section, which is located in the upper casing between the connector and the solenoid valve;

the connector is an electric coupling, which electrically connects the first section to the second section when coupled and which electrically disconnects the first section and the second section when uncoupled;

the connector is disposed in the recess when connected, and when connected the conductor spans the width of the neighboring recesses formed in the bell housing and the upper casing; and when the connector electrically connects the first section of wires to the second section of wires, the inboard controller is electrically connected to the actuator.

7. A shift apparatus according to claim 6, further comprising a waterproof cover which hermetically seals the actuator.

8. A shift apparatus according to claim 6, wherein the coupling includes a first member, which is electrically connected to the first section of the wires, and a second member, which is electrically connected to the second section of wires;

when the first member is coupled to the second member, the connector electrically connects the first section of wires to the second section of wires.

9. A shift apparatus according to claim 6, wherein the connector has a male component and a female component, which are mated when the connector is connected.

* * * * *